US007328827B2

(12) United States Patent
Marks

(10) Patent No.: US 7,328,827 B2
(45) Date of Patent: Feb. 12, 2008

(54) HIGH-START SPRING ENERGIZED STAPLER

(75) Inventor: Joel S. Marks, Sherman Oaks, CA (US)

(73) Assignee: WorkTools, Inc., Chatsworth, CA (US)

( * ) Notice: Subject to any disclaimer, the term of this patent is extended or adjusted under 35 U.S.C. 154(b) by 0 days.

(21) Appl. No.: 11/839,026

(22) Filed: Aug. 15, 2007

(65) Prior Publication Data

US 2007/0272721 A1 Nov. 29, 2007

Related U.S. Application Data

(63) Continuation of application No. 11/343,343, filed on Jan. 30, 2006.

(51) Int. Cl.
*B25C 5/02* (2006.01)
*B25C 5/10* (2006.01)

(52) U.S. Cl. ..... 227/132; 227/134; 227/146

(58) Field of Classification Search ..... 227/120, 227/129, 132, 134, 146
See application file for complete search history.

(56) References Cited

U.S. PATENT DOCUMENTS 2,154,755 A * 4/1939 Krantz ..... 227/129
4,126,260 A * 11/1978 Mickelsson ..... 227/132
5,335,838 A * 8/1994 Harris et al. ..... 227/132
5,699,949 A * 12/1997 Marks ..... 227/132
6,789,719 B2 * 9/2004 Shor ..... 227/132
2006/0016846 A1 * 1/2006 Joyce ..... 227/132
2007/0012745 A1 * 1/2007 Jiang ..... 227/132
2007/0158384 A1 * 7/2007 Zins et al. ..... 227/132

* cited by examiner

*Primary Examiner*—Stephen F. Gerrity
(74) *Attorney, Agent, or Firm*—Paul Y. Feng; Fulwider Patton LLP

(57) ABSTRACT

A spring energized stapler includes a "high start" design wherein a striker has a rest position above the staple track. A handle is pressed to energize a power spring while the striker remains stationary. At a predetermined position of the handle, the striker is released to eject a staple. A subassembly of a cage and the power spring provides a preload to the power spring in the rest position. The subassembly is separately movable from the handle to allow a handle pressing end to move farther than the striker's distance of travel. The handle includes a movable pivot location to enable enhanced motion of the handle pressing end. Alternatively, an optional lever links the striker to the power spring to provide leverage upon the power spring. A release latch may be mounted in front of the striker to be engaged by the lever or the handle.

17 Claims, 9 Drawing Sheets

HIGH-START SPRING ENERGIZED STAPLER

CROSS-REFERENCE TO RELATED APPLICATIONS

This application is a continuation of U.S. application Ser. No. 11/343,343, filed Jan. 30, 2006, whose entire contents are hereby incorporated by reference.

FIELD OF THE INVENTION

The present invention relates to spring powered desktop staplers. More precisely, the present invention relates to improvements to a spring-actuated stapler with a striker having an initial "high start" position.

BACKGROUND OF THE INVENTION

Spring powered staplers and staple guns operate by driving a striker with a power spring. The striker ejects a staple by impact blow. In a desktop stapler, the staple is ejected into an anvil of a pivotably attached base. Two general principles are used. In the first design, the striker has an initial position in front of a staple track. The striker is lifted against the force of the power spring to a position above the staple track. The striker is released to impact and eject the staple. This design may be referred to as a "low start" stapler. A second design uses a "high start" position. That is, the striker has an initial position above the staples loaded on the staple feed track. The power spring is deflected while the striker does not move. At a predetermined position of the power spring deflection, the striker is released to accelerate into and eject a staple. Typical desktop staplers use a high start design. However, in such conventional high start designs, the striker is driven directly by the handle with no power spring to store energy that could be used to drive the striker. There is further no release mechanism for the striker since the striker simply presses the staples directly under handle pressure.

In conventional high start designs that do use a power spring, the power spring is either unloaded or preloaded in the rest position. Different methods are used to reset the mechanism. U.S. Pat. No. 4,463,890 (Ruskin) shows a desktop stapler with a preloaded spring. Restrainer 42*c* is an element of the handle and moves directly with the handle. U.S. Pat. No. 5,356,063 (Perez) shows lever 53 with tips 48 engaging striker 24. At a predetermined position of handle 30, lever 53 is forced to rotate out of engagement from striker 24 and power spring 40 forces the striker downward. Swiss Patent No. CH 255,111 (Comorga AG) shows a high start staple gun with the handle linked to the power spring through a lever. There is no preload restrainer for the power spring so the spring stores minimal energy through the start of the handle stroke. Both references use a releasable link or release latch that is positioned behind the striker and delinked by a direct pressing force from the handle. British Patent No. GB 2,229,129 (Chang) appears to show a high start stapler design. However, no functional mechanism to reset the striker is disclosed. Specifically, no linkage is described to lift the striker with the handle in a reset stroke. The lever 3 resembles a lever used in a low start stapler, but the lever does not lift the striker in any way. Instead, the striker is somehow lifted by a very stiff reset spring, yet no linkage is described to enable a reset spring to lift the striker against the force of the power spring.

SUMMARY OF THE INVENTION

In a preferred embodiment of the present invention, a high start, spring actuated stapler provides a compact stapler that combines enhanced handle travel for greater leverage with a separately movable spring/cage subassembly to preload the power spring. The cage may be pivotably attached to the housing at a location separate from the pivotable attachment of the handle. A striker alternates between an initial position above a staple track and a lower-most position in front of the staple track. A power spring is deflected to store energy by the motion of the handle. At a predetermined position of the handle, the striker is released to accelerate to the lower-most position by urging of the power spring.

The striker moves a minimum vertical distance required to drive staples while the handle, at a handle pressing area, moves substantially farther than the striker to achieve increased leverage and lower actuation force. According to various embodiments, a lever links the handle to a power spring or a spring/cage subassembly to provide the added leverage for the handle, and for added leverage in moving a release latch. According to a further embodiment, the handle includes a movable or slotted pivot attachment near a rear of the housing to provide enhanced travel at the front pressing area of the handle.

In various alternative embodiments, release mechanisms include a lever pivotably and slidably attached in the housing. The lever pivots out of engagement with the striker and slides rearward in a reset action. Further release mechanisms use separately movable latches. For example, a release latch is movably fitted in the housing and is moved out of engagement with the striker or power spring by urging from the lever. The lever does not directly contact the striker. A further embodiment release latch is urged out of engagement by contact with the handle. The various embodiment release latches may be mounted in front of or behind the striker. With the release latch in front of the striker, the power spring may pass behind the latch as the spring moves. The shape of the latch may thus be less constrained by a requirement to clear the power spring and possibly an associated lever. With the latch to the rear of the striker, the power spring can normally pass through a slot of the latch or beside the latch as the spring moves.

A reverse cantilevered reset spring may be integrated as part of a power spring. In one embodiment, the cantilevered reset spring is partially cut out of and formed integrally with the flat beam or bar type power spring. A benefit of this arrangement is that the high stiffness reset spring needs only a short leverage distance to provide a gentle reset force without distorting the main portion of the power spring.

DETAILED DESCRIPTION OF THE PREFERRED EMBODIMENTS

Figure 1A:
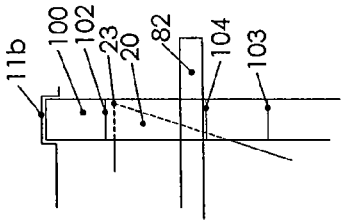
FIG. 1A is a detail view of FIG. 1 showing the striker and lever in their initial position engagement.

FIGS. 1 to 5 show one preferred embodiment of a high start stapler. In the side elevational views of FIGS. 1 and 2, one half of the body has been removed to expose the internal workings. In the some of the drawing figures, the base has been omitted for simplicity and clarity.

An upper body of the stapler including housing 10 is pressed against base 50. Base 50 includes a staple forming anvil (not shown) to fold staples behind a stack of sheet media to be stapled, such as papers (not shown). Any of the staplers of the present invention may also be used as a tacker to install staples into a work surface if the base is rotated away or not used. Lever 20 provides a link between handle 30 and power spring 80. Lever 20 is preferably an elongated U-channel having a rounded back end and an angled leading edge, but a simple flat plate may also be used. Handle 30 has an elongated ergonomic shape and is hinged at its back end against housing 10 at handle pivot 29, considered the rear pivot location. Handle 30 also features handle pressing area 33 near its front end, which is the area where the user is expected to press down on the handle to operate the stapler most efficiently.

Figure 5:
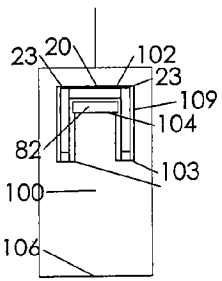
FIG. 5 is a front elevational view of the striker showing the lever and power spring extending through the striker in the positions shown in FIGS. 1 and 2.

In FIGS. 1A and 5, a sharply angled release tip 23 at the end of lever 20 extends through striker 100 into slot 109 under edge 102. Striker 100 is vertically movable through a striker travel path in striker slot 11 between an initial position at upper slot end 11*b* and a post-release, lower-most position at lower slot end 11*a*. An upper end of striker 100 need not extend fully up to upper slot end 11*b*. Release tip 23 therefore serves as a latch that holds striker 100 in the raised position against the downward bias of power spring 80.

Figure 1:
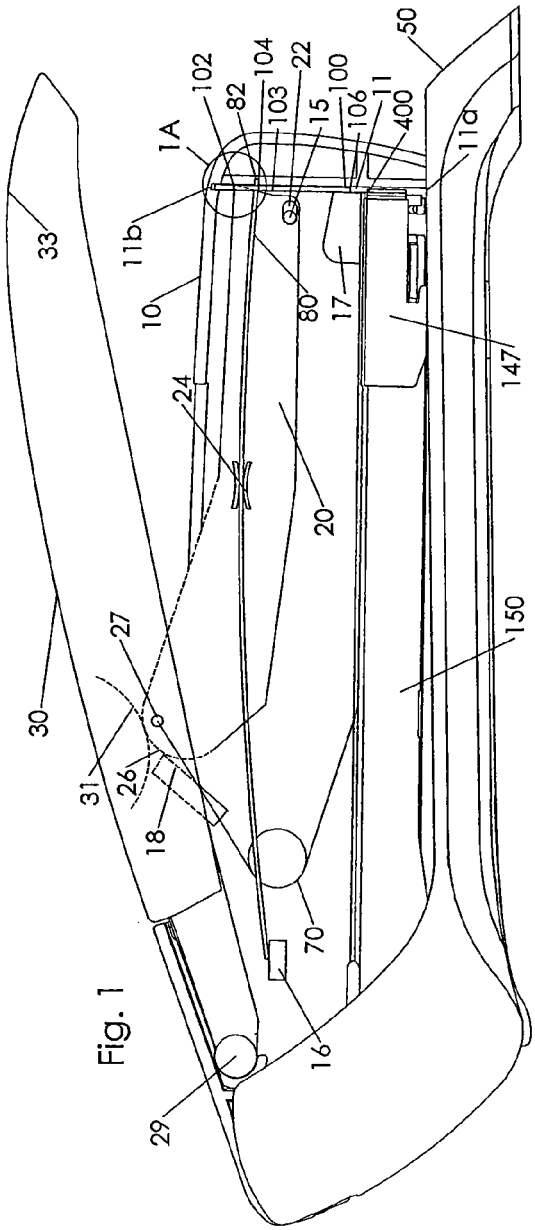
FIG. 1 is a side elevational view of an exemplary embodiment of a high start desktop stapler in an initial position with a right side of the housing removed to show the body rotated to press the base.

In FIG. 1, the initial position of striker 100 preferably locates lower edge 106 above track 150 and staples 400. Pusher 147 under spring power urges staples 400 toward the front of the stapler. Tab or edge 104, shown in FIGS. 1A, 2A and 5, engages spring tip 82 whereby power spring 80 biases striker 100 downward toward staples 400. Lever 20 rotates within housing 10 about pivot 15, which may be a rounded peg extending from the inside wall of housing 10. Handle 30 includes handle link 31 pressing lever link 26. In the preferred embodiment, handle link 31 is a curved, smooth surface attached or formed into the underside of handle 30 while opposing lever link 26 is a like curved, smooth surface formed into lever 20. The opposed curved surfaces of links 36, 21 engage each other and undergo rolling and sliding actions during movement of the respective handle 30 and lever 20. The smooth and curved engagement surfaces ensure low friction therebetween. This area is considered the lever-handle link location. It is preferable that handle 30 and handle link 31 be made from a polymer such as nylon, DERLIN®, or polyolefin for their low friction and strength properties. Optionally, the interface may include a roller or lubricant. For example, one or both of links 31 and 26 may also be in the form of a low friction structure such as a roller.

Figure 2A:
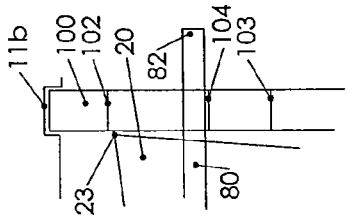
FIG. 2A is a detail view of FIG. 2 showing the striker and lever pre-release engagement.
Figure 2:
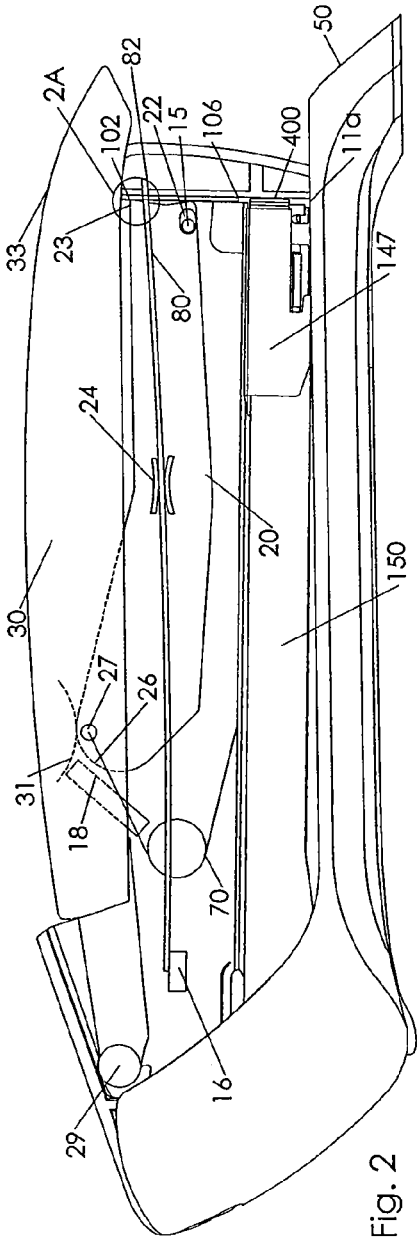
FIG. 2 is the stapler of FIG. 1 in a pre-release position.

As lever 20 rotates counterclockwise about pivot 15 from handle pressure, release tip 23 disengages from striker 100 as it moves from its position in FIGS. 1 and 1A toward its position shown in FIGS. 2 and 2A. The release action occurs by the direct pivoting motion of lever 20 around pivot 15, and is thus indirectly actuated by the downward motion of handle 30. The area at pivot 15 is considered the front pivot location. The travel at the release area of tip 23 is small compared to the handle travel due to the proximity of tip 23 to pivot 15 versus the much greater distance from lever link 26 to pivot 15. The latter distance directly affects the handle travel distance. Consequently, the frictional resistance encountered due to power spring pressure on striker 100 when release tip 23 slides out from under edge 102 is easily overcome by this mechanical advantage; i.e., handle 30 has great leverage to move tip 23 out from engagement. The added friction from the disengagement action is thus minimal.

This advantage contrasts with typical prior art high start releases where an element of the handle directly presses a restraining device used to hold the striker against spring bias. A large pressing effort on the handle is required to move the restraining device to release the striker when the element of the handle first contacts the restraining device.

Lever 20 preferably includes upper and lower tabs 24 that essentially pinch or confine a middle portion of power spring 80 to energize and deflect power spring 80 when lever 20 and power spring 80 move generally in unison in the substantially vertical direction and include any rotational component as well. Pinching tabs 24 further enable relative sliding or lateral movement between lever 20 and power spring 80. Moreover, opposed central tabs 24 have a slight curvature to accommodate any bowing in the power spring during its deflection. The bowing in power spring 80 in FIG. 2 is in the opposite direction as compared to FIG. 1, where potential energy is stored in power spring 80 in FIG. 2 creating a strong downward bias via tip 82 upon striker 100. The area of tabs 24 is considered the lever-power spring link location.

In the preferred embodiment, power spring 80 takes the form of a flat bar spring that has a generally uniform cross-section and overall rectangular shape. In various alternative embodiments, the bar spring may have varying cross-sectional shapes, sizes, and/or thicknesses in order to achieve the desired overall spring rate or stiffness k, a local spring stiffness in the section from between tabs 24 and release tip 23, or a local spring stiffness in the section between tabs 24 and fulcrum 16. Further, the power spring in an alternative embodiment may include, in a profile view, a kink or local bend to affect the spring rate at various positions of the handle travel. In yet another alternative embodiment, a coiled torsion spring may be used as the power spring wherein its helical coils are located near central tabs 24 or equivalent structure with its arms extending frontward and rearward.

With pinching tabs 24, lever 20 can thereby move power spring 80 both downward and upward via pressing or lifting, respectively, at about spring tip 82 and flexing power spring 80 at tabs 24. Other structures may of course be used to link lever 20 to power spring 80. For example, the tabs may be replaced with pins or pegs sandwiching the power spring therebetween, or the power spring may include a tiny, laterally-extending ear that fits into a notch or hole formed in the lever. Through these structures, the up and down movement and any rotational action of lever 20 are transferred to power spring 80. In the exemplary embodiment, as lever 20 rotates toward the position of FIG. 2, power spring 80 bends or bows downward at the center as shown. Power spring 80 is supported at the rear end by fulcrum 16 and at the front end at spring tip 82 by edge 104 of striker 100. In FIG. 2, power spring 80 is energized and striker 100 has been released to accelerate downward under urging of the power spring. Power spring 80 pivots at its rear on fulcrum 16. Striker 100 accelerates down to its lower, post-release position shown in FIG. 3 as power spring 80 re-assumes its rest shape in its generally lower position of FIG. 3.

Optional absorber 17 limits the lower-most travel position of striker 100 and power spring 80. Absorber 17 is preferably made from a resilient material such as rubber, polyurethane, nylon, felt, foam, or the like. Absorber 17 as shown receives the remaining striker inertia and energy from power spring 80 after the staple has already been expelled by the striker blow, or particularly when no staple is present. In various alternative embodiments, absorber 17 may be positioned in front of striker 100 engaging spring tip 82 or a tab of striker 100 instead.

Figure 3:
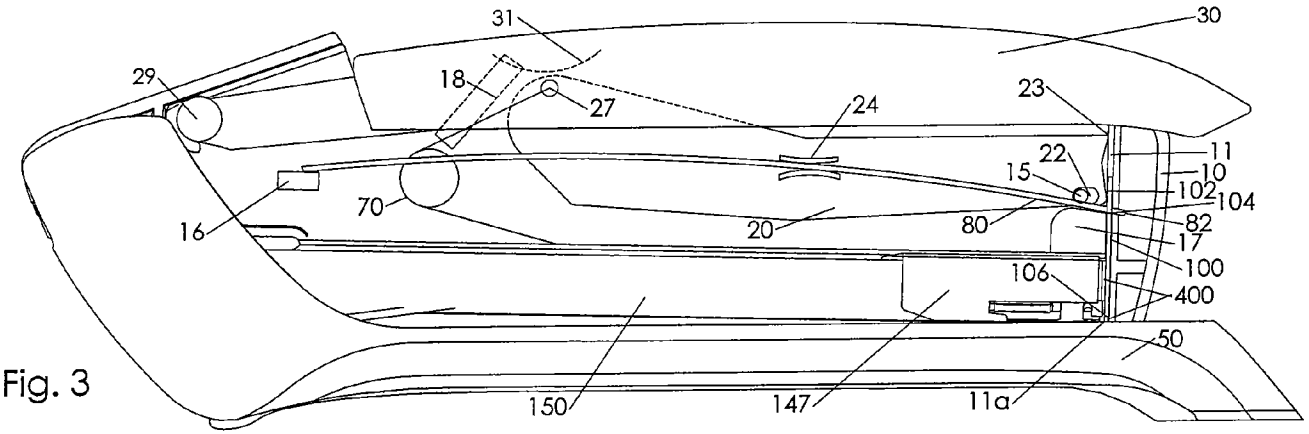
FIG. 3 is the stapler of FIG. 1 after release of the striker and ejection of a staple.

Lever 20 is in substantially the same position in FIGS. 2 and 3. In FIG. 3, striker lower edge 106 has come to a stop proximate to lower slot end 11*a*, while striker 100 is now located in front of track 150 in the striker lower-most position. Still in FIG. 3, the front-most staple 400 has already been expelled and driven into the sheet media as a result of the impact blow by striker 100. Other staples 400 remain situated on track 150.

Reset spring 70 biases the back end of lever 20 upward. In particular, the upper end of an arm of reset spring 70 presses on hole 27 or like anchor in lever 20 to pivot lever 20 clockwise in FIG. 3 about pivot 15. Reset spring 70 is preferably a single or multiple coil torsion spring with outstretched arms at each end. A compression spring or a bar spring may also be used in place of or in combination with the coiled torsion spring.

Lever 20 interacts with its surrounding components such that handle 30 has enhanced leverage upon spring 80. For example, the location where handle 30 presses lever 20, at respective links 26 and 31 (the lever-handle link location), is preferably located between tabs 24 (the lever-power spring link location) and handle pivot 29 (the rear pivot location). Handle pressing area 33 may move generally vertically through a handle travel distance that is substantially greater than the distance tabs 24 or handle link 31 moves during deflection of power spring 80. Handle 30, when pressed near pressing area 33, therefore has enhanced leverage to move lever 20 and to energize power spring 80. This provides great work advantage over the prior art.

In an alternative embodiment in FIG. 11, reset spring 70 may press upon power spring 80 or cage 90 to bias the front of the cage and/or spring upward, discussed later. In still another alternative embodiment (not shown), reset spring 70 may press handle 30 upward. In this embodiment, handle link 31 may have a tensile connection to lever 20 so that handle 30 can pull lever 20, and any items linked to the lever, upward. Also, more than one reset spring 70 may be used in the assembly. For example, a first reset spring may bias handle 30 while an optional, second reset spring may bias lever 20, power spring 80, and/or cage 90 upward.

Figure 4:
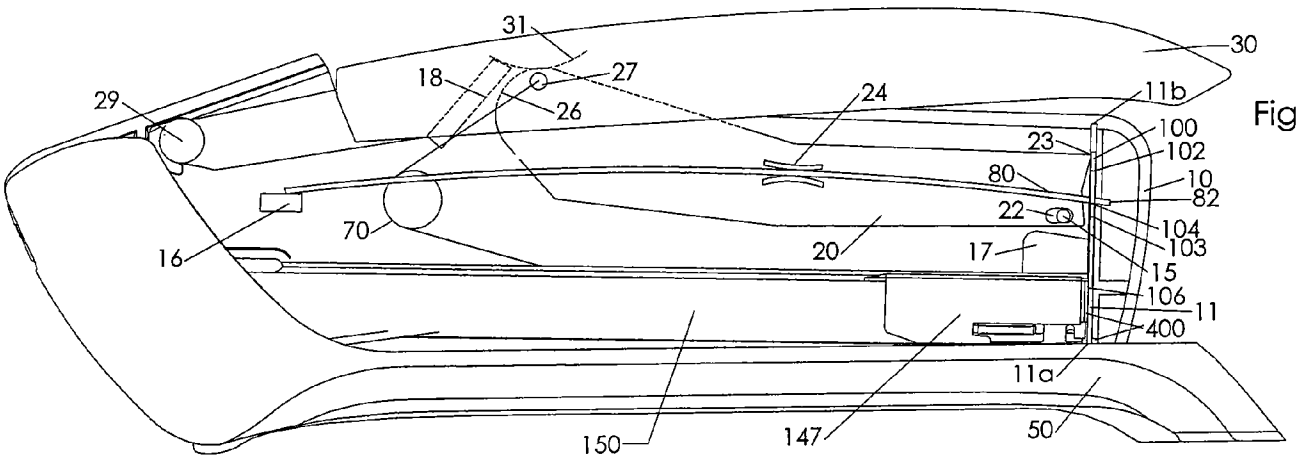
FIG. 4 is the stapler of FIG. 1 in an intermediate reset position.

FIG. 4 shows a reset position of the assembly. In this view, power spring 80 pivots upward, counterclockwise about fulcrum 16. Through its link to power spring 80, striker 100 moves up to contact release tip 23 and lever 20 generally slides rearward along elongated slot 22 containing pin 15. Once lever 20 has moved away from the path of striker 100, striker 100 has room to be translated upward to its initial, high-start position in front of lever 20. Reset spring 70, or the alternative structures discussed above, provides the bias for the upward reset action of lever 20 and power spring 80. At the end of the reset action, the assembly assumes the configuration shown in FIG. 1.

In the reset action of FIG. 4, angled rib 18 formed from or attached to housing 10 presses lever 20 to urge release tip 23 of lever 20 toward striker 100. Angled rib 18 may contact lever 20 directly or a portion of the upper end of reset spring 70 near hole 27. Release tip 23 then moves under edge 102 of striker 100 as shown in FIG. 1A. Slot 109 in FIG. 5 is preferably shaped like an inverted "U." This shape corresponds to a preferably U-channel shaped lever as shown in FIG. 5. Slot 109 extends down to lower edge 103, as seen FIGS. 1A and 5. This extension space in slot 109 provides clearance for the extended, angled, front edge of the U-channel-shaped lever 20. The angled, front edge of lever 20 forms a cam to allow striker 100 in its upward movement simultaneously to force lever 20 rearward during the reset stroke, as depicted in the change from FIG. 3 to FIG. 4. Alternatively, striker 100 may include a forward, angled segment (not shown) to slide along the front of lever 20.

Other shapes may be used for lever 20 and slot 109, including a flat formed lever and linear slot.

Figure 9:
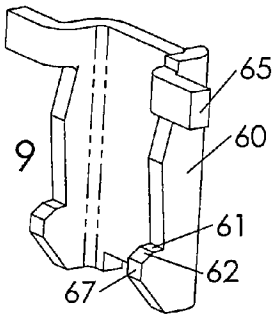
FIG. 9 is a perspective view of a lever driven release latch.
Figure 7A:
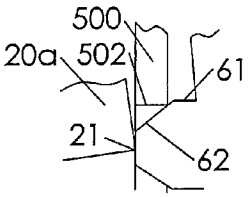
FIG. 7A is a detail view of FIG. 7 showing a striker and lever pre-release engagement.
Figure 6A:
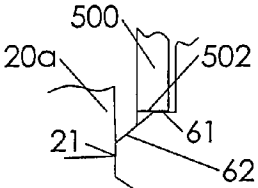
FIG. 6A is a detail view of FIG. 6 showing the striker and lever in their initial position in engagement.
Figure 8:
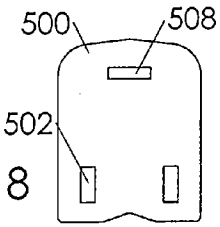
FIG. 8 is a front elevational view of the striker of FIG. 7.
Figure 7:
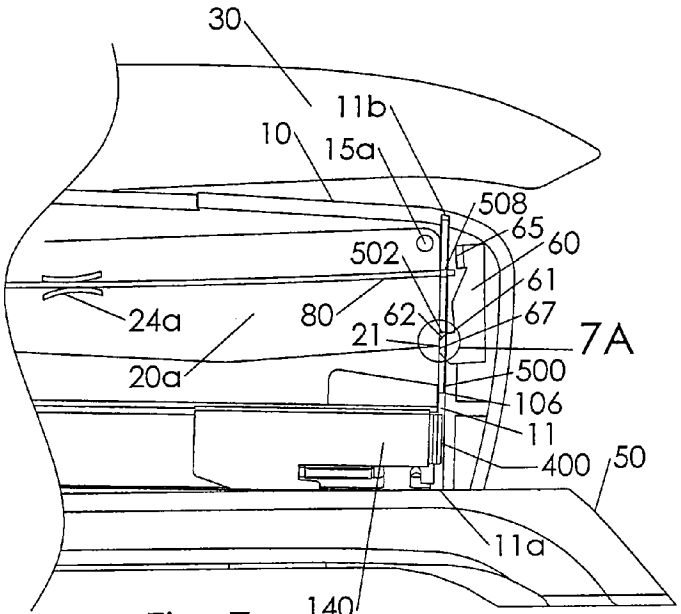
FIG. 7 is the stapler of FIG. 6 in a pre-release position.
Figure 6:
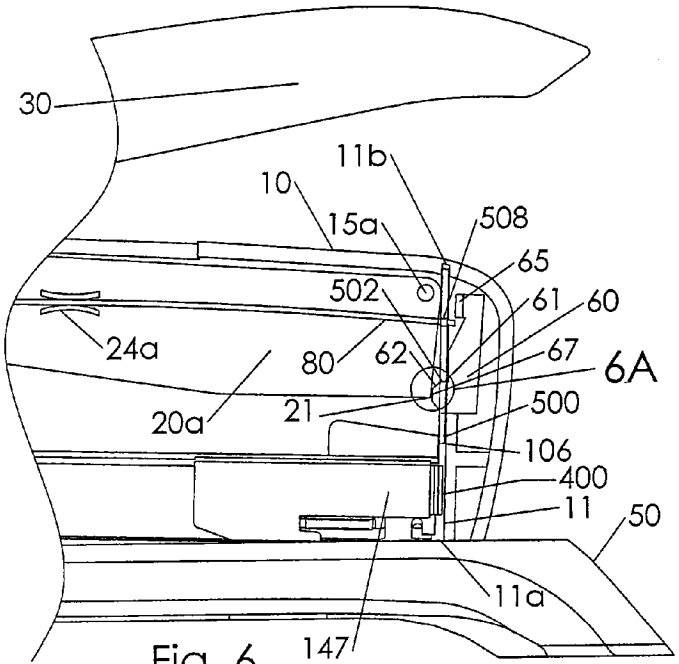
FIG. 6 is a side elevational view of an alternative embodiment high start stapler in an initial position, showing the front portion in a detail view with a lever driven release element.

FIGS. 6 to 10 show a further embodiment of the present invention. In FIGS. 6 and 7, a front area detail of a stapler is shown. The remaining structures not appearing in the FIGS. 6 and 7 are comparable to the embodiment shown in FIGS. 1-4. Release latch 60 holds striker 500 in the raised initial position as seen in FIGS. 6 and 6A. Release latch 60, as best seen in FIG. 9, is preferably a separate, discrete part from lever 20*a*. Release latch 60 pivots about outstretched wing-like tabs 65, where wing-like tabs 65 are pivotably supported in housing 10 by means known in the art. Hooked tabs 67 of release latch 60 extend through respective slots 502 of striker 500, as best seen in FIG. 8. Hooked tab 67 includes flat shelf 61 transitioning into chamfer 62.

Release latch 60 is lightly biased toward striker 100 by a resilient member such as a spring, rubber or polyurethane foam padding, felt strip, spring clip, rubber bumper, etc. (not shown) positioned in front of latch 60. In the case that housing 10 is constructed of a plastic material, the resilient member is preferably a cantilevered post extending from the interior of housing 10 pressing release latch 60 near the free distal end of the post. According to this embodiment, there is no need for an additional component to bias latch 60.

In FIGS. 6 and 6A, the stapler is in an initial position. As handle 30 is pressed downward, lever 20*a* rotates about pivot 15*a*. Pinching tabs 24*a* force power spring 80 to bow downward at the tabs while becoming angled upward near the tip as shown in FIG. 7. Power spring 80 presses striker 500 at slot 508. Striker 500 in turn presses shelf 61 of release latch 60 at slot 502. As lever 20*a* rotates counterclockwise about pivot 15*a* in FIG. 6, bottom corner 21 of lever 20*a* moves toward hooked tabs 67, engages hooked tabs 67, and pushes hooked tabs 67 out of slots 502 of striker 500. This instantly releases striker 500 for its downward travel for an impact blow with a staple. In an alternative embodiment, lever 20*a* may continuously engage hooked tabs 67 of release latch 60 through the motion of lever 20*a* including the release action. More precisely, at a predetermined position as seen in FIG. 7A, shelf 61 of release latch 60 shifts out of striker slot 502 and striker slot 502 then presses chamfer 62. The unstable angled engagement of striker slot 502 against chamfer 62 causes the downward biased striker 500 to force hooked tab 67 entirely out from slot 502. Striker 500 is then released for its downward travel for an impact blow with a staple.

The striker release point is therefore when shelf 61 of release latch 60 just exits slot 502 in striker 500 and chamfer 62 makes contact with striker 500. Thus, the location of hooked tab 67 where chamfer 62 meets shelf 61 is a release area of the latch. According to this structure, lever 20*a* and release latch 60 can be on opposites sides of striker 500, while lever 20*a* can disengage latch 60 from striker 500 without lever 20*a* extending into the thickness of striker 500 or into the striker travel path defined by slot 11.

On the other hand, if chamfer 62 is omitted, then shelf 61 forms a simple corner on hooked tab 67. Then lever 20*a* at bottom corner 21 must pass into slot 502 to force shelf 61 to exit striker slot 502. This structure could function if lever 20*a* were slidable in housing 10, but could cause lever 20*a* to interfere with the downward movement of striker 500. Also, release latch 60 may optionally be oriented oppositely where tabs 65 are at a bottom area below tab 67. Other pivotable or movable mountings may be used in place of release latch 60. Furthermore, release latch 60 has a U-channel shape as shown in FIG. 9, or may have a flat bar shape engaging a central portion of striker 500 or like configurations. For example, a flat latch may resemble one of the sides of latch 60, wherein a bar includes a hook extending from the bar. To create hooked tab 67 of release latch 60, the structure may be a lanced, bent or angled, or tab punched from a flat metal blank.

The features of chamfer 62 and shelf 61 need not be immediately proximate. Rather, they may be at separate locations of latch 60. For example, a tab including only chamfer 62 may extend through a slot of striker 500, while a tab including shelf 61 extends through a separate slot of striker 500.

Bottom corner 21 of lever 20*a* may push release latch 60 entirely out of striker slot 502. In one embodiment (not shown), the release latch may extend around striker 500, in the side direction in FIG. 8 rather than through slots 502. The release latch would be wider. Then lever 20*a* could press the release latch out of engagement with the striker by passing to the side of striker 500. Striker 500 can translate downward without interference from lever 20*a*. In this example, a tab that is pressed by lever 20*a* is remotely positioned from the feature that holds striker 500 in its upper position.

In yet another alternative embodiment, lever 20*a* may include a slot (although not shown in FIG. 6) containing pivot 15*a* therein, similar to the elongated slot 22 containing pivot 15 in FIG. 4. Lever 20*a* can then slide rearward out of the way under the force of the spring biased striker 500. Release latch 60 may be mounted behind striker 500 whereby pivoting lever 20*a* causes latch 60 to disengage striker 500. In this instance, pivot 15*a* may be located near a bottom, front of lever 20*a* so that the top corner of the lever can pull the release latch out from engaging striker 500. Other like structures may be used to release a latch that is behind striker 500.

Figure 10:
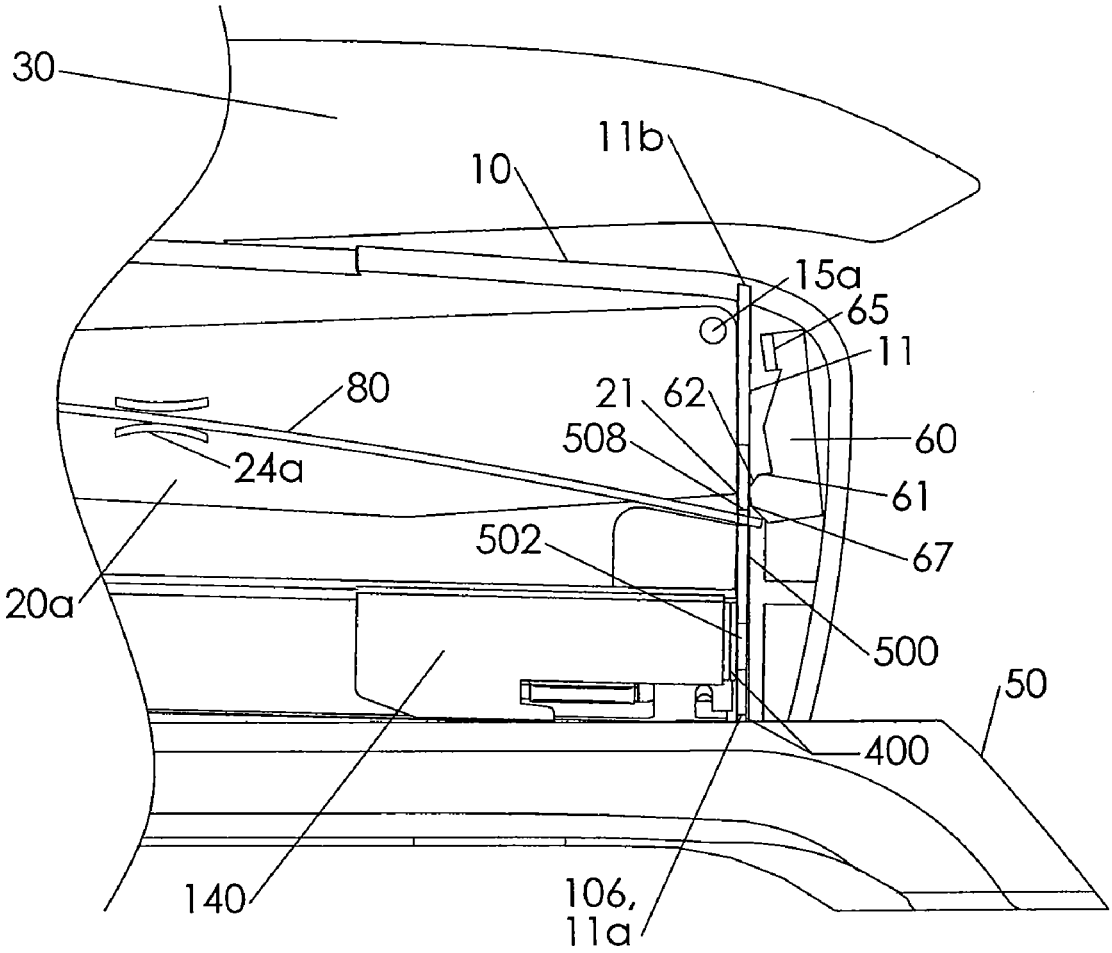
FIG. 10 is a partial side elevational view of the front of the stapler of FIG. 6 after release of the striker and ejection of a staple.

In FIG. 10, striker 500 has been released and is depicted in its lowest position. Release latch 60 is angled away from striker 500 with hooked tab 67 gently pressing striker 500. During a reset stroke, a reset spring operates similar to reset spring 70 in FIGS. 1-4, or according to the other options discussed herein, to return the components back to their initial positions. In the reset stroke, striker 500 moves upward and slides gently against hooked tab 67. Striker slot 502 moves up with striker 500 and eventually aligns with hooked tab 67. At this moment, hooked tab 67 becomes trapped within striker slot 502 and holds striker 500 in its initial position. The reset position of the stapler is generally precise as hooked tabs 67 can be precisely located within housing 10.

Figure 11:
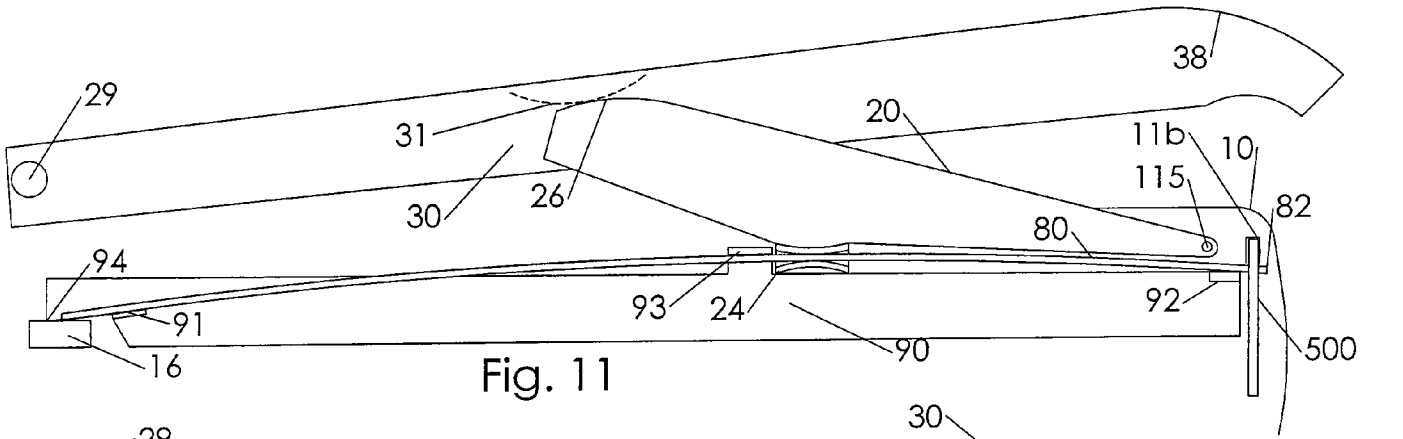
FIG. 11 is a side elevational view of a cage and power spring subassembly with certain stapler components shown and others omitted, wherein the spring is in the initial upper pre-loaded rest position.
Figure 12:
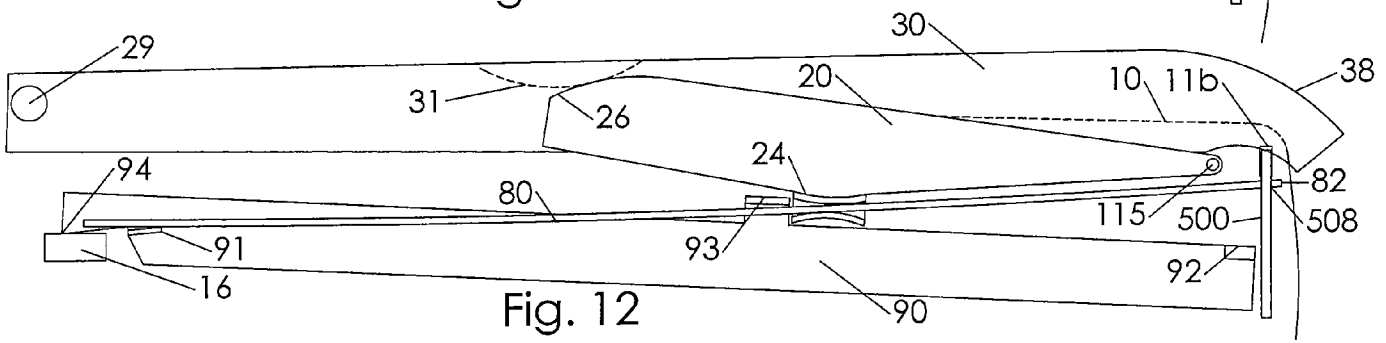
FIG. 12 is the assembly of FIG. 11 with the cage angled to a low position and the spring in a pre-release position.
Figure 13:
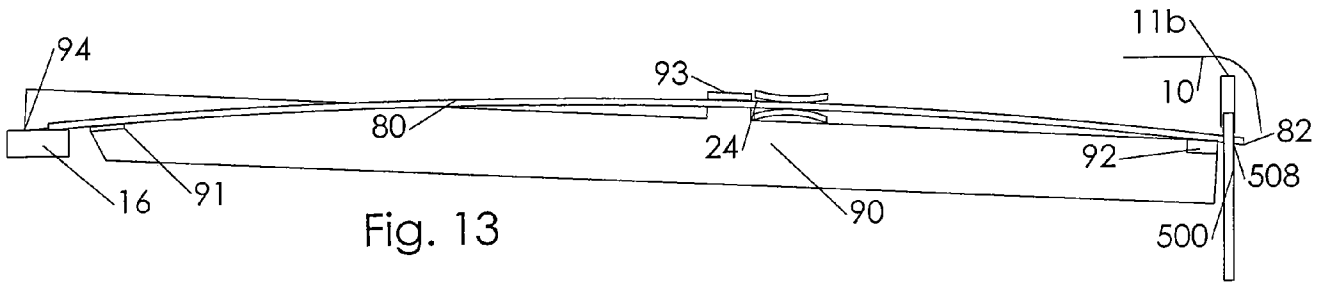
FIG. 13 is the assembly of FIG. 11 with the spring and cage in respective low rest positions of a post-release condition.

FIGS. 11 to 13 show stapler structures that provide a preload to power spring 80. A striker latching mechanism to hold striker 500 in the pre-release position of FIG. 12 is not shown for simplicity. Various latch designs as disclosed may be used. In the previous drawing figures, power spring 80 is unloaded or unstressed in its upper rest position or shape. It is also substantially unstressed in the post release rest position. Yet there may be some load upon the power spring if the handle continues to move after release, or other geometries are intentionally selected to provide such additional deflection. It is desirable, however, to preload the power spring so that it can store energy through the full stroke of handle 30.

FIGS. 11 and 12 show a subassembly of power spring 80 and cage 90 used with representative components from the embodiment of FIGS. 1-5 by adding cage 90. Cage 90 confines power spring 80 so that the power spring cannot relax to its free position. More precisely, cage 90 holds power spring 80 to pre-stressed upper and lower rest positions. In FIG. 13, handle 30 and lever 20 have been omitted for simplicity. Cage 90 includes rear tab 91, center tab 93, and front tab 92; rear tab 91 and front tab 92 support the front and rear ends of power spring 80 from the bottom while center tab 93 presses down in a middle area of power spring 80. These confining tabs 91, 92, 93 thus pre-stress power spring 80 without any input from handle 30 or lever 20. Tabs 91, 92, 93 may have other geometries or surfaces of cage 90 near the respective rear, front, and center locations of power spring 80.

To further enhance pre-stressing of the power spring, it is contemplated in an alternative embodiment (not shown) to provide a flat, elongated power spring similar to that shown in FIGS. 11-13, but which already has a bowed profile in its free state. Thus, placing the bowed power spring into the confining tabs 91, 92, 93 in a state of bending opposite to the natural, bowed shape increases the amount of pre-stress in the power spring. Moreover, the flat spring may have different thicknesses along its length to change its local spring rate k, for example, to decrease spring stiffness near striker 500 by decreasing thickness or width in that area, and/or to increase thickness and spring rate k near a center section so the spring may more efficiently store energy along its entire length. In this example, the spring stiffness corresponds to the bending stress upon the spring at the different locations of the spring.

Tabs 24 press the cage/spring subassembly to deflect power spring 80 to an energized position. Tabs 24 may be part of lever 20, or optionally tabs 24 may be part of handle 30 where tabs 24 are instead non-tab-like structures such as flat portions, recesses, etc. Accordingly, lever 20 or handle 30 may press power spring 80 directly as shown or indirectly via cage 90. Either pressing method provides generally equivalent deflection and energizing of power spring 80.

In the initial position shown in FIG. 11, both cage 90 and power spring 80 are in an uppermost position at their respective front ends. In the pre-release position of FIG. 12, power spring 80 is deflected and energized remaining in the upper position at tip 82 while cage 90 pivots or angles downward at tab 92. This corresponds to the position of FIG. 2 or FIG. 7 without the cage element. In the released position of FIG. 13, power spring 80 at tip 82, cage front at tab 92, and the cage/spring subassembly are in their lowest post-release rest positions. In FIG. 13, the front of cage 90 has pivoted to cause the cage to be angled downward with respect to the cage position of FIG. 11. FIG. 13 corresponds to FIG. 3 or 10. In the context of preloading the power spring, the rest position is the shape of the spring when the spring has not been deflected or energized from its preloaded shape against cage 90. The upper and lower rest position or shape may also describe the position or shape of a subassembly of the power spring and the cage when the power spring is not deflected.

When lever 20 or handle 30 presses power spring 80 directly, cage 90 becomes loosely fitted in the assembly. For example, FIGS. 16-19 show a further embodiment with a handle optionally pressing the power spring directly.

Returning to FIGS. 11-13, cage 90 can pivot near the rear end at contact 94 located optionally near tab 91, to swing the front end. Pivoting contact 94 is separate from handle pivot 29 to provide one method that cage 90 is separately movable from handle 30. Optionally, cage 90 may be translatable in the housing rather than pivotably mounted as shown. If lever 20 or handle 30 presses cage 90 rather than power spring 80, then the cage is more confined from moving. In either case, cage 90 can move separately from handle 30 since cage 90 is not an attached element of handle 30.

Pressing area 38 of handle 30 is positioned generally above striker 500. In the example of FIGS. 11 and 12, pressing area 38 moves downward through a "handle travel" about twice the distance of what the front end of cage 90 moves down near tab 92 and striker 500. Handle travel is the distance the pressing area moves as the power spring is deflected. According to this feature of the present embodiment, a high start spring powered stapler is very compact in its height since the "striker travel" is the minimum necessary from just above the staple track to in front of the staple track. At the same time, the handle is not rigidly fixed to the preloading features of cage 90, tab 92 in this example, and lower post 191 in the example of FIG. 14. Described another way, neither tab 92 nor lower post 191 is an element or component of handle 30 or 130 in the preferred embodiments. Therefore, handle movement can be enhanced through linkages as disclosed herein for increased leverage and lower pressing force while the restraining device of the cage moves minimally to follow the compact striker action.

In prior art designs, a restraining device preloads a power spring near the striker. Typically, the restraining device is rigidly linked to the handle, being a part of the handle assembly. For example, U.S. Pat. No. 4,463,890 (Ruskin) at column 4, line 15, discloses a restrainer end portion 42*c*' that pre-biases the power spring 44. Restrainer 42*c* depends from inside the handle as part of an inner frame or shell 42 and moves directly with the handle. Because of this rigid connection, the handle of Ruskin '890 cannot travel more than the travel of restrainer 42*c* and beneficial leverage is lost.

In typical light duty desktop staplers, the striker needs to move not more than about 0.5 inch to clear and eject staples. Any more vertical motion requires a housing or body to be taller than necessary to fit the highest striker position. Therefore, with a handle-linked restrainer as shown in Ruskin '890, the handle cannot move more than 0.5 inch and still be contained in a compact design near the front end or pressing area of the handle. Such limited handle travel thus restricts prior art designs to a lower leverage, higher actuation force operation. Heavier duty staplers have proportionately even greater minimum striker travel to clear the taller staples. On the other hand, the increased handle travel with respect to the striker and cage of the present invention allows a compact housing with no restriction on the available handle leverage.

Figure 14:
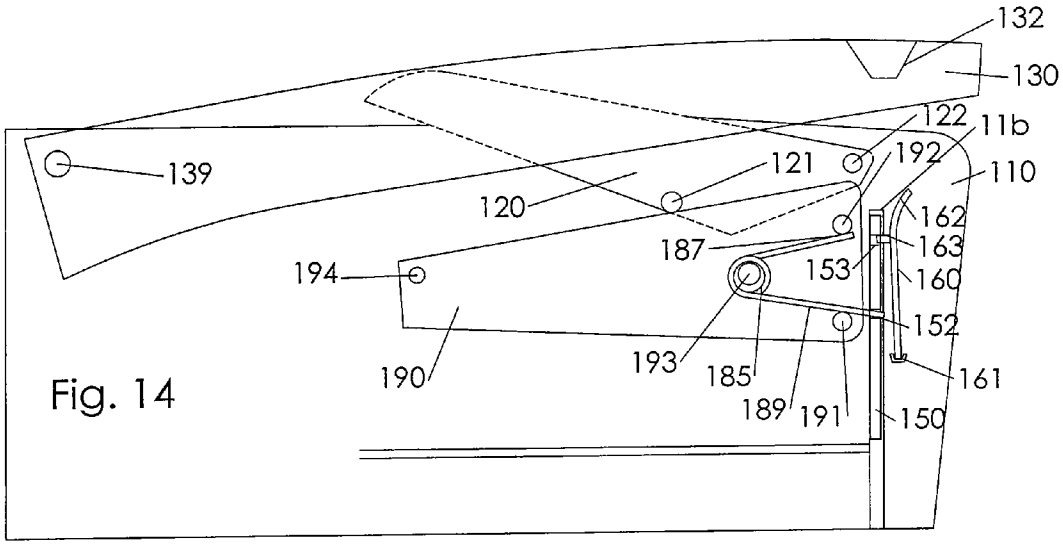
FIG. 14 is a side elevational view in a schematic representation of an alternative embodiment power spring and cage design in an initial position.
Figure 15:
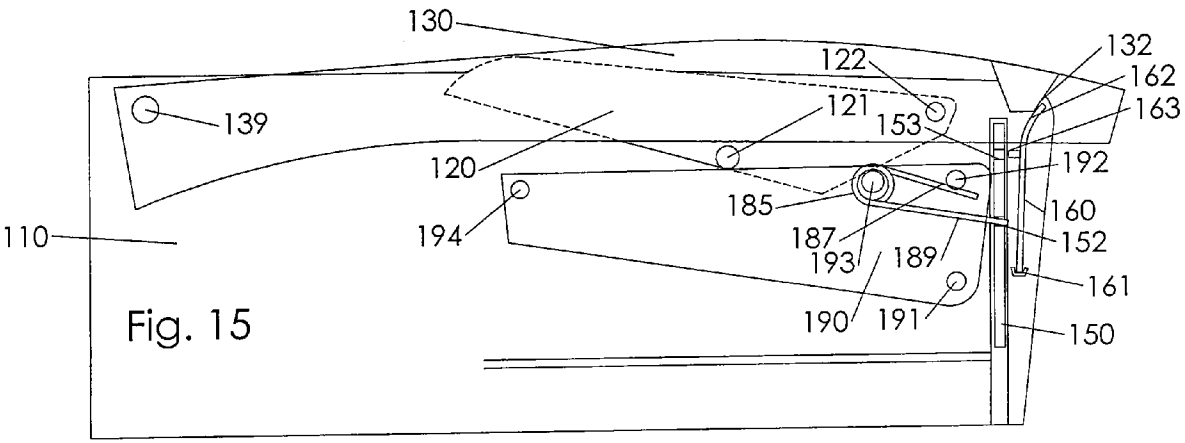
FIG. 15 is a side elevational view in a schematic representation of the embodiment of FIG. 14 in a pre-release position.

FIGS. 14 and 15 show, in simplified schematics, an alternative embodiment cage and torsion spring subassembly. Power spring 185 has a helical coil configuration and includes parallel, forward-extending arms. Handle 130 is pivotably attached to housing 110 at pivot 139. Pivot 139 is separate from pivot 194 about which cage 190 rotates. Handle 130 links to power spring 185 through lever 120 at tab or link 121. Specifically, the transfer of applied force starts from the user's hand to handle 130 to lever 120 to link 121 to cage 190 to power spring 185. As seen in FIG. 15, release latch 160 is actuated directly by force from handle 130 applied at cam 132 against latch surface 162 rather than by lever 120. Release latch 160 is movably supported at its bottom at recess 161, and near its top holds striker 150 in place by latch tab 163 extending into slot 153 of striker 150 to resist the downward pressure applied by power spring arm 189 on striker 150. The downward bias is produced by lower spring arm 189 acting downward on slot 152 of striker 150. In an alternative embodiment, a tab of the striker may engage a slot in latch 160. Optionally, lever 120 may actuate latch 160 by methods discussed above.

Lever 120 rotates about point 122. Cage 190 rotates about point 194. Upper post 192 and lower post 191 confine upper spring arm 187 and lower spring arm 189 respectively in the upper rest position of FIG. 14. On the other hand, in the pre-release position of FIG. 15, lower post 191 moves down away from lower spring arm 189 which is still trapped in slot 152 of striker 150. After release, striker 150 and lower spring arm 189 accelerate downward until lower spring arm 189 contacts or is near to lower post 191. Power spring 185 is at this moment confined again by cage 190 in a lower rest position of the power spring. Posts 191 and 192 may take other forms aside from the pegs as shown, such as tabs, slots, holes that the spring arms may hook into, etc.

In both embodiments disclosed above, cage 90 for use with elongated spring 80 in FIGS. 11-13, and cage 190 for use with torsion power spring 185 in FIGS. 14-15, the cage is indirectly moved by the handle. A lever provides an intermediate linkage so that the cage front end, adjacent to the striker, moves less than a pressing area of the handle immediately above the striker. The effect of this structure is that the handle can travel more than the amount of striker travel through a stroke that deflects the power spring. A vertically compact housing 10 or 110 fits the minimally moving striker, while the handle travel is larger for greater leverage and thus lower actuation force than a handle that is restricted to moving the same distance during spring deflection as the striker moves upon ejecting staples.

FIGS. 16 to 19 show a still further embodiment. As in some of the foregoing drawings, the stapler base is not shown for simplicity. Handle 230 moves separately from cage 190*a*. The handle travel at pressing end 235 is enhanced without the use of an intermediate lever to link striker 140 to handle 230. Handle 230 links directly to the subassembly of cage 190*a* and power spring 180.

Figure 16:
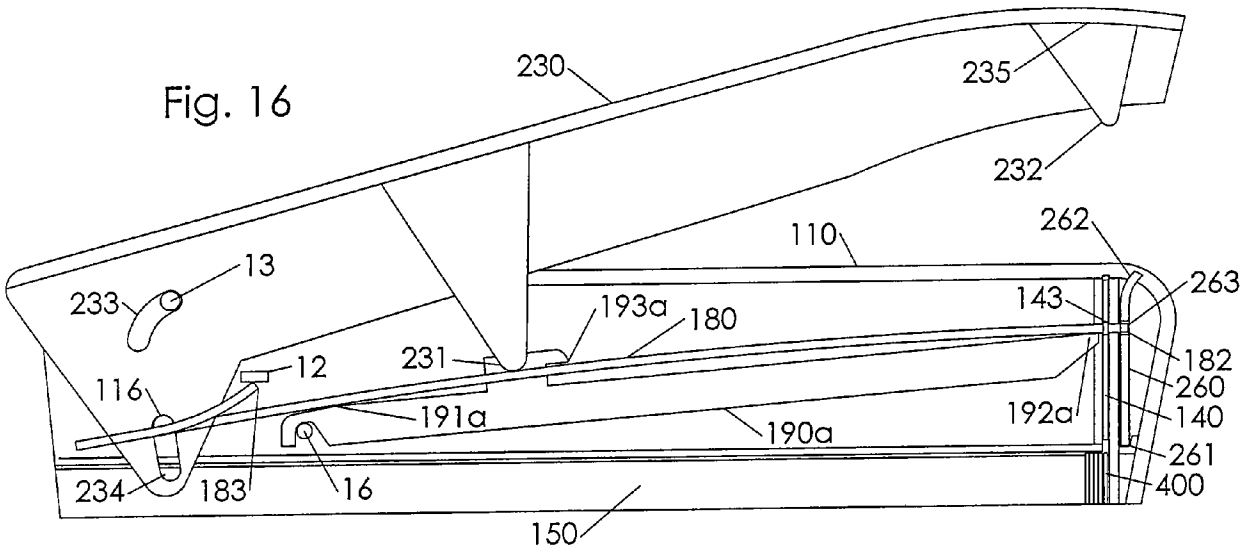
FIG. 16 is a side elevational view of another alternative embodiment stapler with a right housing portion removed to show an initial position using a movable pivot location for the handle.
Figure 19:
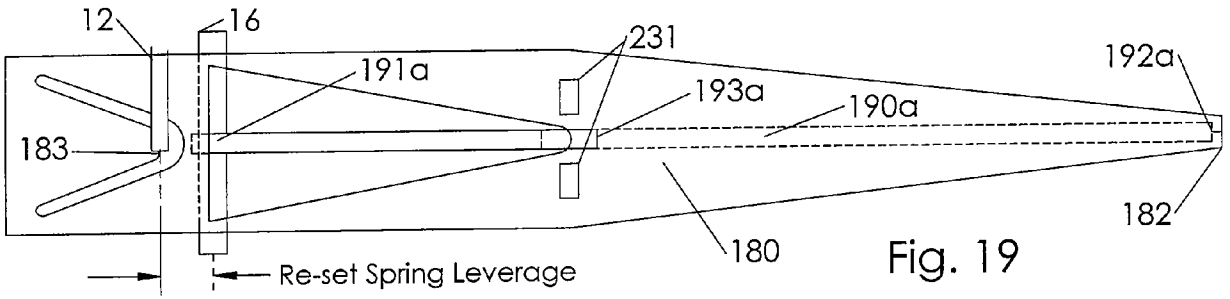
FIG. 19 is a plan view of the flat power spring/cage subassembly of FIGS. 16 to 18 with an integrated reset spring.
Figure 19A:
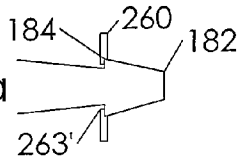
FIG. 19*a* is an alternative embodiment release latch design.

A modified pivot design between handle 230 and housing 110 provides the enhanced leverage of handle 230. A power spring and cage subassembly are shown in FIG. 19. In FIG. 16, the stapler is shown in an initial position. Power spring 180 is in an upper rest position pre-stressed against cage 190*a*. Handle 230 is in its high or highest position. Cage 190*a* pivots about fulcrum or mount 16 of housing 110 and is angled upward toward the front. In an alternative embodiment, cage 190*a* may be loosely attached (not shown) at its rear end while power spring 180 is pivotably held in housing 110. Spring front tip 182 of power spring 180 extends through slot 143 of striker 140. Spring front tip 182 further extends through slot 263 of release latch 260. Slot 263 may equivalently take the form of a top edge of latch 263. Release latch 260 is pivotably attached at recess 261 in front of striker 140, and is gently biased by a resilient member (not shown) to engage spring front tip 182. Release latch 260 may optionally be located behind striker 140 as seen in the plan view of FIG. 19*a*. In the embodiment of FIG. 19*a*, release latch 260 at slot 263' moves rearward to disengage from shoulders 184 of spring front tip 182. In yet another alternative embodiment (not shown), release latch 260 extends through an opening of power spring 180 and releases from an edge of the opening rather than the outer shoulders 184.

Figure 17:
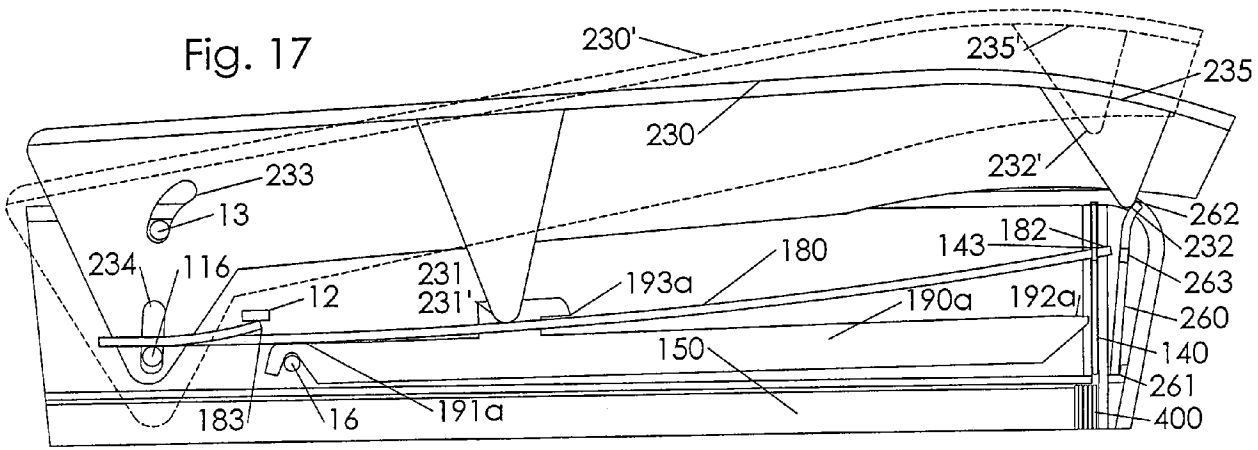
FIG. 17 is the stapler of FIG. 16 with the handle in a pre-release position and a handle with a non-movable pivot depicted in phantom lines.

In the FIG. 17 embodiment, when handle 230 is rotated downward to the end of its handle travel, power spring 180 is deflected to its energized state. Cam 232 extends from underneath handle 230 and has a sloped leading edge. After a predetermined amount of handle travel, the sloped leading edge of cam 232 engages and forces release latch 260 out of contact with spring 180, preferably by pressing lead-in surface 262, which is a curved extension of release latch 260. Once front tip 182 of power spring 180 disengages from release latch 260, which has now been pushed away by cam 232 in FIG. 17, power spring 180 is free to press down on striker slot 143 and accelerate striker 140 downward into staples 400 below. The impact blow of striker 140 against staple 400 ejects the staple from the stapler.

Cage 190*a* flips or angles downward in FIG. 17 from its initial position in FIG. 16, rotating near rear end 191*a* about fulcrum 16. In an alternative but functionally equivalent embodiment, cage 190*a* may move downward at both ends (not shown) to become loose at both ends in the pre-release condition of FIG. 17. If power spring 180 is pivoted within housing 110 near rear end 191*a*, the effect is comparable to a pivoted cage rear end since the cage rises up after release back to the position of FIG. 18 by pivoting about fulcrum 231. Handle fulcrum 231 is preferably a projection extending from underneath handle 230 and terminating in a rounded, pivot point. In the exemplary structures of FIGS. 16-18, there is minimal space under rear end 191*a* of the cage, so any vertical movement at the rear end would be negligible.

Figure 18:
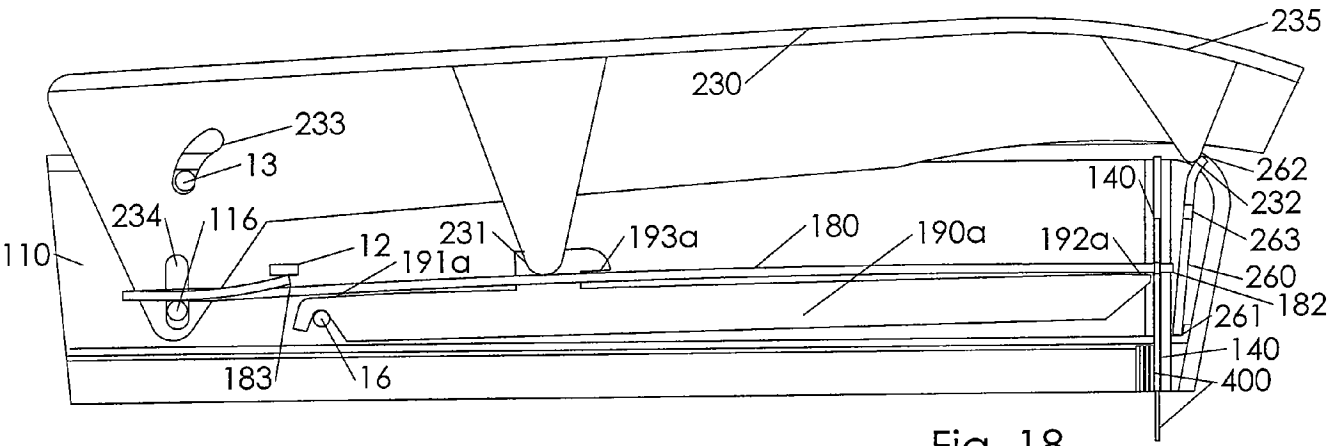
FIG. 18 is the stapler of FIG. 16 in a post release position with the striker located in front of the staple track after ejecting a staple.

In FIGS. 16-18, the pivot point of handle fulcrum 231 presses directly upon power spring 180; the rounded tip allows handle 230 to rock and slide laterally on power spring 180. Cage 190*a* is loosely contained in FIG. 17. Front end 192*a* of cage 190*a* can freely move up until a top edge of the cage touches power spring 180. Optionally, handle fulcrum 231 may press upon cage 190*a*, on or near tab 193*a* or other location of cage 190*a*. In either case, cage 190*a* moves separately from handle 230 thus improving leverage as discussed earlier.

In FIG. 18, power spring 180 has moved down to cause the cage/spring subassembly to assume its lower rest position. A front-most staple 400 has been ejected. In a desktop stapler, the ejected staple would have pierced and be bent behind a stack of papers after being deformed on an anvil (not shown). In the reset stroke, the cage/spring subassembly, along with striker 140, moves back to the position of FIG. 16. The advantage of the separate movement of the handle and cage are apparent from previous discussions, and are further dramatized in the following description.

In the embodiment depicted in FIGS. 16-18, handle 230 at its back end has a pivot location that moves relative to housing 110. Specifically, handle 230 has a guide slot 233 that is captured by guide post 13 extending from housing 110. Of course, the slot may be formed in the housing while the post is part of the handle. Guide slot 234 has a generally linear shape and is located proximate to post 116. As handle 230 rotates downward toward the position of FIG. 17, the curved-shape guide slot 233 enables the rear end of handle 230, proximate to slot 233, to move upward and forward with respect to housing 110. In FIG. 17, curved guide slot 233 has guided handle movement at its rear end upward and forward via cam action at guide post 13 as the handle rotated. From FIG. 16 to FIG. 17, handle 230 at straight guide slot 234 has translated upward around post 116.

For comparison of handle movement, handle 230' is shown in phantom in FIG. 17. Handle 230' represents the position of the handle if there were no cam action—that is, if guide post 13 were not present and straight guide slot 234 were a simple hole. Then handle 230' would pivot about guide post 116 at the fixed pivot location of FIG. 16. In FIG. 17, it is seen that pressing area 235 on handle 230 moves farther with the cam action than pressing area 235' (phantom) on handle 235' without the cam action. In both instances, the cage/spring subassembly and the power spring deflection are in the same position and are pressed by fulcrum 231, 231' extending from handle 230, 230'.

It follows then that handle 230, at pressing area 235, moves farther thus creating increased leverage when the cam action enables the rear end of handle 230 to rise. Under common physical principles, leverage is directly proportionate to the handle travel, all other things equal. Because of the greater handle travel at the pressing area in the embodiment of FIG. 17, a lower pressing force therefore results with the cam action. Optionally, one or both of posts 13 and 116 may be roller linkages or other low friction engagements including recesses to fit extensions of handle 230. Furthermore, handle 230 may include posts or recesses to engage cam slots or ribs of housing 110. Other intermediate structures may provide a movable pivot linkage at the rear of handle 230.

Cage 190*a* and power spring 180 move in direct relation to striker 140 since power spring 180 is directly linked to striker 140. In an alternative embodiment, handle 230 may be pressed even farther in FIG. 18 to move cage front end 192*a* down past the lower rest position, for example, to contact the housing rib shown just below cage front end 192*a* in FIG. 18. By such extreme travel, the cage front area has even greater clearance from power spring 180. A minimal amount of such clearance may be desired to prevent impact upon cage 190*a* by power spring 180. However, this clearance should be minimal since the handle is only forced slightly back up under the bias of the power spring to return the cage/spring subassembly back to the rest condition. This extra deflection of the power spring requires energy input to the power spring that is lost upon rebound of the handle and does not provide useful staple driving power.

In describing the movement of the cage/spring subassembly and the pivotably-slidably-linked striker 140, it is intended to include the distance between the upper rest position of FIG. 16, or equivalent rest position in FIG. 11, and the lower rest position of FIG. 18, or equivalent position in FIG. 13. These distances are also considered as the striker travel.

According to an earlier example, striker 140 moves a striker travel of about 0.5 inch from its initial position above track 150 in FIG. 16 to the lower-most position in front of track 150 in FIG. 18 in an exemplary, compact desktop stapler. The cage/spring subassembly travels about the same distance near striker 140 between upper and lower rest positions. Handle 230, at pressing area 235, moves about twice that distance or about 1 inch. This is a 2-to-1 leverage ratio of handle travel to power spring/cage subassembly front end motion, or striker travel. Other leverage ratios may be achieved depending on the configuration of the cam action, or the sizing of the levers of the previous embodiments. As discussed earlier, the levers shown in many of the FIGS. 1 to 15 provide an enhanced handle-travel-to-striker-travel relationship similar to that of FIGS. 16 to 18 by allowing the spring/cage to move separately from the handle.

FIGS. 16-18 depict one exemplary embodiment of a power spring/cage subassembly. Staples 400 are held in a track chamber and supported on a feed track (not shown). FIG. 19 is a plan view of the power spring/cage subassembly. In this exemplary embodiment, a reset spring is integrally formed from the same material as power spring 180. Specifically, resilient spring arm 183 acting as the reset spring is formed as a partial cut-out at the back end of power spring 180. Resilient spring arm 183 presses anchoring rib 12 extending from housing 110. Spring arm 183 is part of a rearward extension of power spring 180 beyond fulcrum 16.

As seen in FIG. 19, spring arm 183 is cantilevered from a base formed in power spring 180 and located well to the rear of rib 12. Spring arm 183 extends toward fulcrum 16 and is spaced from the fulcrum post 16 by the distance denoted as "Re-set Spring Leverage" in FIG. 19. The inherently high spring force of the stiff spring material selected for power spring 180 operates over a short distance to produce a low reset torque. When spring arm 183 is preloaded to press upon rib 12 in the upper rest position of FIG. 16, spring arm 183 does not move greatly as the central portion of power spring 180 is deflected to the position of FIG. 17, so the reset torque does not change greatly. It can be seen that spring arm 183 is only slightly different in shape between FIGS. 16 and 17, and that spring arm 183 has no substantial effect on the overall shape or profile of power spring 180. The result of this structure is that spring arm 183 provides a gentle bias to move front end 182 of power spring 180 upward toward the initial power spring position of FIG. 16 to reset the mechanism of the stapler.

Figure 20:
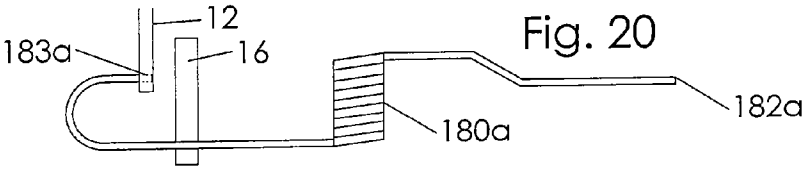
FIG. 20 is an alternative embodiment torsion power spring with an integrated reset spring.

FIG. 20 shows an alternative embodiment torsion power spring 180*a* having a helical coil with oppositely extending arms. Front end 182*a* of power spring 180*a* engages the striker (not shown in FIG. 20). Fulcrum 16 supports the rear end of power spring 180*a*. Rib 12 presses forward-extending distal end 183*a* to provide the reset function as described above with respect to spring arm 183 of FIG. 19. A cage (not shown) similar in design to cage 90 of FIG. 11 may preload torsion spring 180*a* by supporting the central coil and the front and rear ends. Therefore, a torsion spring such as that shown in FIG. 20 may be used in any of the embodiments disclosed herein. In various alternative embodiments, the torsion spring may have arms extending in various directions, including parallel to each other as in FIG. 14 or opposite to each other as in FIG. 20. The cage design can be configured by those skilled in the art to accommodate the particular power spring design, whether bending or torsion, to provide a preload upon the power spring and allow further deflection of the power spring.

In FIG. 19, fulcrum 231 is optionally pressing directly on power spring 180 as discussed earlier. Power spring 180 is a flat spring that optionally includes varying cross-sections for efficient function. Central cage tab 193*a* extends from under power spring 180 through the opening shown in FIG. 19 to hook the power spring from above. Rear end 191*a* and front end 192*a* of cage 190*a* press against power spring 180 from below. With this arrangement, power spring 180 and cage 190*a* can be readily assembled to form the preloaded spring/cage subassembly. The subassembly is separate from handle 230 and does not exert any preload force upon the handle. As a result, the subassembly can be easily inserted into the main stapler assembly including housing 110 before or after handle 230 is installed.

The resilience of power spring 180, or any other similar power spring, is preferably stiff to provide staple driving power. In the preferred embodiment, the flat bar power spring 180 should provide a peak force acting on the striker of between about 10 to 20 lbs. for a standard desktop stapler. Heavy duty staplers or staple guns require substantially more force, up to about 50 lbs. for example. Such stiff material is normally not compatible with the light force required for a reset spring since the reset spring serves only to reposition and restore the moving parts within the stapler to their pre-fire condition.

For instance, in Swiss Patent No. CH 255,111 (Comorga AG), a rear distal end of a power spring provides a reset function. However, the main portion of the power spring is greatly deflected in the process as seen by the shape of the spring near post 5 of FIG. 1. This large deflection is caused by the rear distal end of the spring moving a large distance as the central operating portion is also deflected. The reset spring thus behaves with much greater stiffness than is needed, effectively acting as two power springs that are deflected while only one provides useful driving power. The exemplary embodiment of FIG. 16-18 avoids this problem.

In FIGS. 16-18, release latch 260 disengages from front end 182 of power spring 180. As seen in FIG. 17, front end 182 is angled upward in the pre-release position as compared to the upper rest position of FIG. 16. This increased angle provides a bias in front end 182 that urges disengagement from release latch 260 at slot 263. The angle of front end 182 may be selected so that there is just enough friction to prevent release latch 260 from being unstable and accidentally sliding off of front end 182. From empirical observations, the angle of front end 182 ranges preferably from about 2° to about 15° from the horizontal, inclusive of the outside limits. Then a light force applied by cam 232 forces release latch 260 to disengage. Accordingly, the extra force required to actively disengage release latch 260 is reduced as compared to a conventional, non-angled spring end.

In an alternative embodiment (not shown), a passive release mechanism may purposely provide that the angle of spring end 182 is large enough that release latch 260 is unstable and tends to slide out from under power spring 180 in the pre-release position of FIG. 17. Then cam 232 extends farther downward (not shown) and, under normal operation, abuts release latch 260 to prevent it from moving. At the pre-release position of FIG. 17, the extended cam 232 moves out of engagement with release latch 260 allowing the unstable release latch to disengage from power spring 180 and/or striker 140.

In yet another alternative embodiment, a lever (not shown) may normally engage release latch 260 and upon urging by handle 230, the lever disengages from release latch 260 at the pre-release position of the handle to allow the release latch to slide out from under power spring 180 when the release latch engagement against power spring 180 or striker 140 becomes unstable. The foregoing passive release designs may be applied to a release latch fitted behind the striker wherein the release latch may move toward the striker for release.

Figure 22:
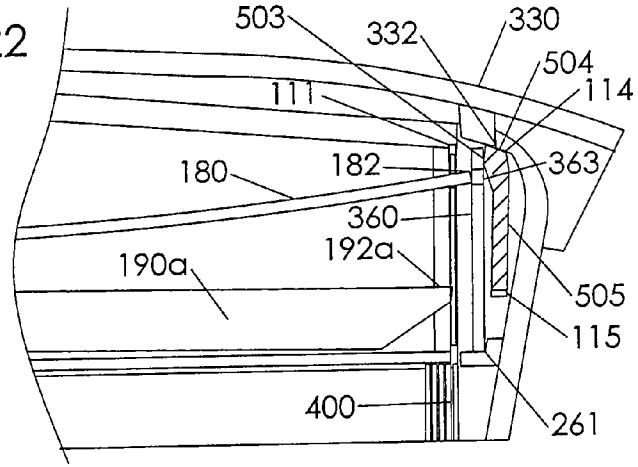
FIG. 22 is the stapler of FIG. 21 with the stapler in a pre-release position.
Figure 23:
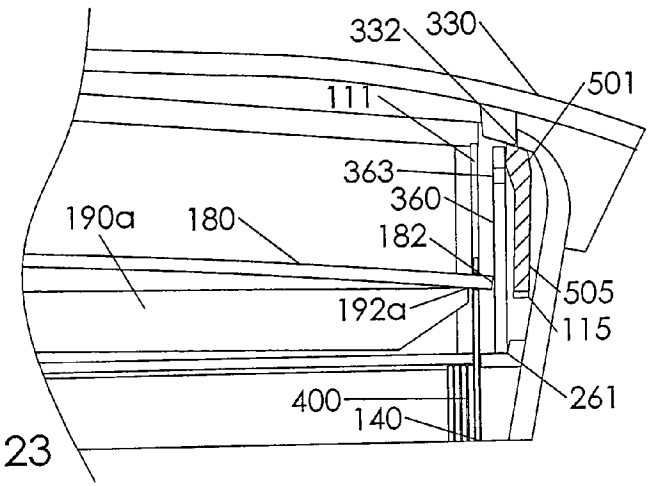
FIG. 23 is the stapler of FIG. 21 after release of the striker.
Figure 21:
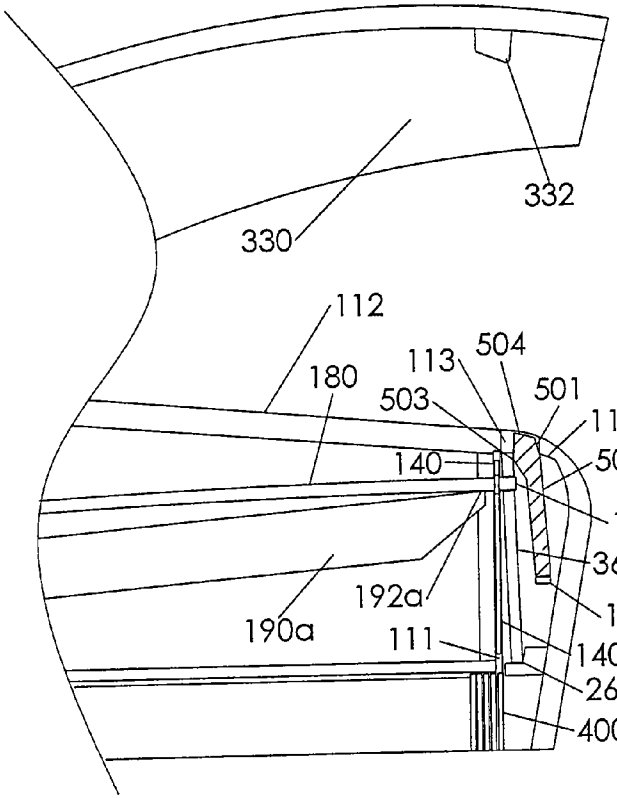
FIG. 21 is a detailed elevational view of a stapler having an alternative embodiment release design, where the stapler is in a rest position.

FIGS. 21 to 23 show a further embodiment of a passive release design according to the two preceding paragraphs. The components are shown schematically in a detail of the front portion. Further operating elements may function as shown in FIGS. 11-20 or equivalently. Cage 190*a* includes front end 192*a* in an example as shown using these parts from FIGS. 16-18, although other mechanisms may be incorporated to actuate a power spring and striker. Power spring 180 includes front tip 182 at which the power spring is pivotably linked to striker 140, for example, through an opening in striker 140. Striker 140 is slidably fitted in housing 112 at guide 111. Latch 360 is pivotably or movably mounted in the housing at mount 261.

In the rest position of FIG. 21, latch 360 is tilted toward striker 140 whereby spring tip 182 extends through opening 363 of latch 360 to form a releasable engagement between latch 360 and striker 140. Latch 360 may engage power spring 180 or striker 140 by other engagements as discussed earlier. For example, in FIGS. 14 and 15 the latch releasably engages the striker directly. As handle 330 is pressed toward housing 112, power spring 180 is deflected to bend as in FIG. 22, in a manner similar to that described for FIG. 17. In the present case, spring tip 182 becomes angled enough that the engagement to latch 360 is unstable. Specifically, in FIG. 22, latch 360 moves forward as shown under the angle and bias of power spring tip 182. Near to the start of the pressing stroke from the rest position, spring tip 182 is less angled so latch 360 is inherently stably engaged to striker 140. Alternatively, the latch-to-striker engagement may be unstable for all positions. For example, latch tab 163 of FIG. 14 may be angled to urge latch 160 forward as striker 150 is forced downward.

To hold unstable latch 360 to striker 140 and power spring 180, cam 505 selectively or releasably obstructs motion of latch 360. Cam 505 extends into opening 113 of housing 112. Stop face 503 of the cam presses or contacts latch 360 to prevent the latch from moving out of engagement with striker 140. As discussed earlier, latch 360 or equivalent structure may be positioned behind striker 140. Then cam 505 may also be behind the striker. Cam 505 is movable in housing 112 against bias of resilient tab 115. Optionally, cam 505 may include an internal resilient portion between a fixed lower portion and a movable upper portion. The resilient action biases cam 505 toward the rest position of FIG. 21. Cam 505 is exposed at opening 113 whereby handle 330 can press upon cam 505 at cam actuating surface 504.

As seen in FIG. 22, cam 505 has been pressed into housing 112 by extension 332 of the handle until the cam aligns with shelf 114. Cam 505 is then free to move forward into a recess of the housing. Latch 360 is likewise free to move forward and disengage spring tip 182. Striker 140 and power spring 180 move to the lower position of FIG. 23 to eject a staple 400. Cam 505 includes chamfered or angled face 501 to provide a light bias for cam 505 to move downward as the cam is pressed against a corner of shelf 114 by latch 360. The angle allows cam 505 to move very slightly forward or away from latch 360 as the cam is pressed downward while the motion is not enough to cause a release action. The angle is great enough to assist handle 330 in pressing cam 505, but shallow enough that friction between the cam and surrounding parts does not allow the cam to spontaneously move. Cam 505 is preferably made from a low friction material such as acetal plastic, or otherwise lubricated.

Other structures or variations upon cam 505 may be used to hold latch 360 selectively or releasably engaged with striker 140/power spring 180. As described earlier, a passive release design may hold a latch engaged with the striker/power spring assembly through an attached part of handle 330, for example, an elongated cam or extension 332 that normally contacts latch 360 to hold the latch engaged. Or a separately movable part such as cam 505 or other equivalent lever structure may provide an intermediate link between handle 330 and latch 360, with the intermediate structure selectively held in a rest position by slight friction, detent or other holding action against the surrounding components. The cam or lever may include sliding, translating, and/or pivoting motions in housing 112. As shown in FIGS. 21-23, cam 505 includes various such motions.

The actuating force required upon handle 330 is primarily determined by the stiffness of spring 180 as long as frictional losses are minimized. As described above, the force required to move cam 505 is minimal. The embodiment according to FIGS. 21 to 23 has minimal sliding between components, and minimal disengagement force. There are generally few sliding movements in the action as power spring 180 is energized. For instance, cage 190*a* moves within housing 112 but does not rub or significantly slidably press other elements as it moves.

When the handle directly, or through an intermediate link, causes the release of the striker by an action of the handle near the distal end of the handle, as shown in FIGS. 14 to 23, the release is relatively precise with respect to handle position. Specifically, the release can be controlled to be precisely near the lower most travel position of the handle since the release is directly tied to the handle position. The latest possible release provides improved performance since the housing has no opportunity to bounce up in a kick-back action.

It is understood that various changes and modifications of the preferred embodiments described above are apparent to those skilled in the art. Such changes and modifications can be made without departing from the spirit and scope of the present invention. It is therefore intended that such changes and modifications be covered by the following claims.

I claim:

1. A spring actuated stapling device, comprising:

a body;

a track along a bottom of the body to guide staples toward a front of the stapling device;

a handle pivotably attached to the body wherein the handle includes an initial rest position where the handle is pivoted to a farthest position away from the body, and a pre-release position where the handle is pivoted toward the body;

a striker movable vertically within the body between an initial rest position above the track and a lower-most position in front of the track;

a power spring disposed within the body linked to the striker, wherein the power spring includes a relaxed free state, a pre-stressed rest state, and an energized deflected state, the power spring being deflected and energized as the handle moves from the farthest position to the pre-release position;

a cage at least partially confining the power spring to normally retain the power spring in the pre-stressed state, wherein at least the power spring and cage form a spring/cage subassembly, the spring/cage subassembly being separately movable from the body and from the handle; and the spring/cage subassembly having an upper position wherein the power spring is in the pre-stressed rest state, and a lower position wherein the power spring is in the pre-stressed rest state.

2. The stapling device of claim 1, wherein the energized deflected state of the power spring includes at least one portion of the cage being in a lower position.

3. The stapling device of claim 1, wherein the energized deflected state of the power spring includes the cage being loosely confined in the spring/cage subassembly.

4. The stapling device of claim 1, wherein a front end of the cage is adjacent to the striker.

5. The stapling device of claim 1, wherein the power spring comprises an elongated flat form including metal.

6. The stapling device of claim 1, wherein the power spring comprises a torsion spring, and arms of the torsion spring press the cage.

7. The stapling device of claim 1, wherein the power spring and the cage are coextensive to form an elongated spring/cage subassembly.

8. The stapling device of claim 1, wherein the handle is linked to the spring/cage subassembly through a lever.

9. The stapling device of claim 1, wherein the handle is linked to the spring/cage subassembly at a handle fulcrum, and wherein the fulcrum is located between the pivotal attachment of the handle to the body and a pressing area of the handle.

10. The stapling device of claim 1, wherein a base is pivotably attached toward a rear of the body, the base including a staple forming anvil below the striker.

11. A spring actuated stapling device, comprising:

a body;

a track along a bottom of the body to guide staples toward a front of the stapling device;

a handle pivotably attached to the body wherein the handle includes an initial position where the handle is pivoted to a farthest position away from the body and a pre-release position where the handle is pivoted toward the body;

a pressing area of the handle positioned above the striker, the pressing area including a handle travel distance between the handle initial position and the handle pre-release position;

a striker movable vertically through a striker travel distance within the body between an initial rest position above the track and a lower-most position in front of the track;

a power spring disposed within the body and linked to the striker to bias the striker into the lower-most position;

a cage at least partially confining the power spring to normally retain the power spring in a pre-stressed state, a combination of at least the power spring and cage forming a spring/cage subassembly, the spring/cage subassembly being separately movable from the body; and the handle having enhanced handle travel at the pressing area of the handle for enhanced leverage on the power spring, wherein the handle travel distance is greater than the striker travel distance.

12. The stapling device of claim 11, wherein the striker travel distance is about 0.5 inch.

13. The stapling device of claim 11, wherein the striker travel distance is less than about 0.5 inch.

14. The stapling device of claim 11, wherein the handle travel distance is about twice the striker travel distance.

15. The stapling device of claim 11, wherein the handle travel distance is about 1.0 inch.

16. The stapling device of claim 11, wherein a base is pivotably attached toward a rear of the body, the base including a staple forming anvil below the striker.

17. The stapling device of claim, 11 wherein a reset stroke includes the cage/spring subassembly moving along with the striker to the rest position.

* * * * *

UNITED STATES PATENT AND TRADEMARK OFFICE

CERTIFICATE OF CORRECTION

PATENT NO. : 7,328,827 B2
APPLICATION NO. : 11/839026
DATED : February 12, 2008
INVENTOR(S) : Joel S. Marks It is certified that error appears in the above-identified patent and that said Letters Patent is hereby corrected as shown below:

Column 4, line 43, delete "DERLIN" and insert --DELRIN--.

Signed and Sealed this

Fifth Day of August, 2008

JON W. DUDAS
*Director of the United States Patent and Trademark Office*